United States Patent [19]

Outani et al.

[11] Patent Number: 4,887,692

[45] Date of Patent: Dec. 19, 1989

[54] NOISE REDUCING DEVICE FOR MARINE PROPULSION

[75] Inventors: Hiroaki Outani; Seiji Inoue, both of Hamamatsu, Japan

[73] Assignee: Sanshin Kogyo Kabushiki Kaisha, Hamamatsu, Japan

[21] Appl. No.: 180,539

[22] Filed: Apr. 12, 1988

[30] Foreign Application Priority Data

Apr. 13, 1987 [JP] Japan ..... 62-90403

[51] Int. Cl.[4] ..... F01N 1/06

[52] U.S. Cl. ..... 181/235; 181/229; 181/239; 181/176; 60/312; 440/89; 440/900

[58] Field of Search ..... 181/229, 233, 235, 204, 181/260, 261; 440/89, 900

[56] References Cited

U.S. PATENT DOCUMENTS 3,120,876 2/1964 Lirette ..... 181/229
3,431,882 3/1969 Irgens ..... 181/235 X
4,604,069 8/1986 Taguchi ..... 440/89 X
4,734,070 3/1988 Wondek ..... 181/229 X
4,753,318 6/1988 Mizuno et al. ..... 181/204

FOREIGN PATENT DOCUMENTS 6220921 7/1985 Japan .
6224278 7/1985 Japan .

*Primary Examiner*—B. R. Fuller
*Attorney, Agent, or Firm*—Ernest A. Beutler

[57] ABSTRACT

A number of embodiments of silencing devices for marine propulsion units using acoustical lenses that are positioned across either the air inlet device, the air exhaust device or both. The acoustical lenses direct the sound waves in such a way so as to effect silencing while, at the same time, ensuring that water will not enter the engine combustion chambers. The invention is shown in conjunction with both outboard motors and inboard mounted engines.

21 Claims, 6 Drawing Sheets

NOISE REDUCING DEVICE FOR MARINE PROPULSION

BACKGROUND OF THE INVENTION

This invention relates to a noise reduction device for marine propulsion and more particularly to an improved arrangement for silencing the noises emanating from the propulsion units used in watercraft.

One of the principal problems in connection with watercraft propulsion units is the silencing of the noise emanating from the power plant. Although the sources of these noises are well known, the actual and effective silencing of them presents considerable problem. For example, it is well known that the induction system for introducing atmospheric air to the engine is a source of noise. In a similar manner, the exhaust system for the engine gives rise to noise. Various arrangements have been incorporated for attempting to silence both the induction and exhaust system noises. However, it is very difficult to provide an arrangement that will both effectively silence the noise emanating from these systems and, at the same time, will not interfere with the effective introduction of intake air and/or the effective discharge of the exhaust gases without high exhaust gas back pressure.

The problems of silencing the intake air system for a marine propulsion unit are particularly acute in conjunction with marine outboard motors. For example, with such arrangements the power head of the engine and its induction system is positioned in close proximity to the operator. Therefore, even though a variety of induction silencing devices have been incorporated, they are not fully effective in silencing all induction system noises without unduly restricting the ability of the engine to ingest atmospheric air.

It is, therefore, a principal object of this invention to provide an improved silencing system for a marine propulsion unit.

It is a further object of this invention to provide an improved arrangement for silencing the intake air of an outboard motor or other marine propulsion device.

In connection with the provision of outboard motors, the induction system can be provided with a number of baffles in order to assist in air silencing. However, the use of such baffles gives rise to certain problems in that the baffling tends to trap water in the induction system and may permit it to enter the engine induction system, an undesirable condition.

It is, therefore, a still further object of this invention to provide an improved induction system silencing device for a marine propulsion unit that will effectively silence the intake air and which will also preclude the induction of water into the engine.

In connection with internal combustion engines used in marine propulsion, it is a normal practice to discharge the exhaust gases to the atmosphere back through the body of water in which the watercraft is operating. The use of the body of water as a silencing device is very effective. However, under slow speed running conditions, the underwater discharges can give rise to unduly high back pressure and hence an above the water atmospheric exhaust gas discharge is employed for operating under these running conditions. However, because of its very nature, the above the water exhaust gas discharge does not provide significant or effective silencing. Although a variety of silencing devices have been proposed, these devices tend to reduce the exhaust efficiency and, accordingly, engine performance.

It is, therefore, a still further object of this invention to provide an improved exhaust silencing device for a marine propulsion unit.

It is a further object of this invention to provide an improved exhaust silencing device for silencing above the water exhaust gas discharges in marine propulsion units.

As with the induction system, the use of silencing devices in the exhaust system can, at times, tend to cause the accumulation of water in the exhaust system which could, under some circumstances, reenter the engine combustion chambers with undesirable results.

It is, therefore, yet another object of this invention to provide an improved exhaust silencing device for a marine propulsion unit in which water is precluded from reentering the exhaust system and engine combustion chambers.

Recently it has been proposed to employ a type of silencing device which acts as an acoustical lens. This type of silencing device has a curved surface through which a plurality of openings extend so as to permit the focusing of the sound waves at a focal point whereby the sound waves in effect interfere with each other and provide silencing. This type of device is effective in silencing noise without significantly reducing the flow. However, the application of this type of a device to a marine propulsion unit presents a number of problems. For example, the device should be incorporated in such a way so as to not interfere with the flow of either induction system gases or exhaust gases, depending upon which if either system it is employed in and, furthermore, the device should provide for water separation and ensure that water cannot enter the engine combustion chamber through either the induction system or the exhaust system.

It is, therefore, a still further object of this invention to provide an arrangement for adapting an acoustical silencing device of the lens type to a marine propulsion unit.

SUMMARY OF THE INVENTION

This invention is adapted to be embodied in a marine propulsion unit that is comprised of an internal combustion engine having an output shaft and a marine propulsion device driven by the engine output shaft. The engine has an induction system comprises of an atmospheric air inlet device for delivering an air charge to the engine for its combustion and an exhaust system having an exhaust outlet device for discharging exhaust gases from the engine to the atmosphere. In accordance with the invention, an acoustical lens extends at least in part across one of the devices for silencing the sounds emanating therefrom.

DETAILED DESCRIPTION OF THE PREFERRED EMBODIMENTS OF THE INVENTION

Figure 1:
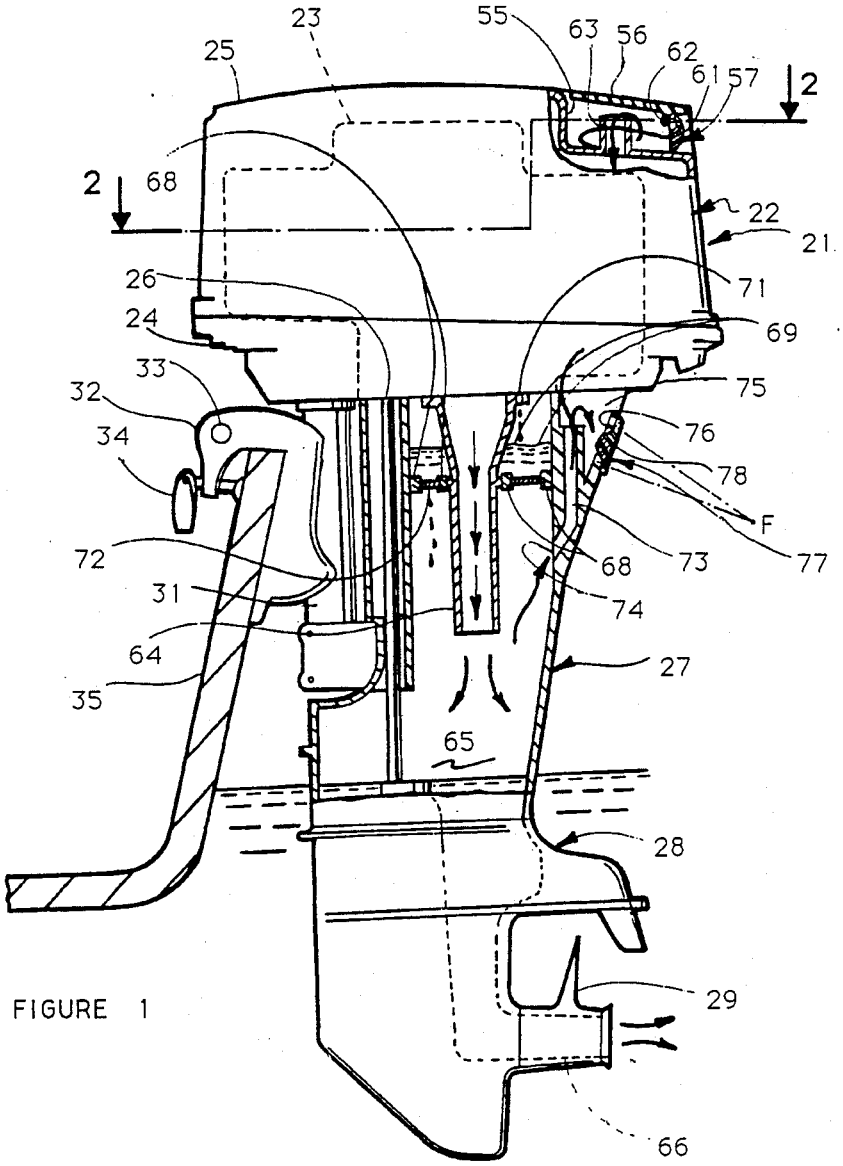
FIG. 1 is a side elevational view of an outboard motor constructed in accordance with an embodiment of this invention, as attached to the transom of a watercraft shown partially and in cross-section, with portions of the motor broken away to show in more detail the construction.

Referring first to the embodiments of FIGS. 1 through 6, an outboard motor constructed in accordance with this embodiment of the invention is identified generally by the reference numeral 21. The outboard motor 21 is comprised of a power head, indicated generally by the reference numeral 22 that includes a powering internal combustion engine 23 which may be of any known type but which has an intake and exhaust system, as will be described. The power head 22 is completed by means of an outer cowling which encircles the engine 23 and which is comprised of a lower tray 24 and a main cover piece 25 that is detachably affixed to the tray 24 in a known manner.

The engine 14 drives a drive shaft 26 that rotates about a generally vertically extending axis and is contained within a drive shaft housing, indicated generally by the reference numeral 27. A lower unit 28 is affixed to the lower end of the drive shaft housing 27 and contains a forward neutral reverse transmission (not shown) for driving a propeller 29 in a known manner.

A steering shaft is affixed in a suitable manner to the drive shaft housing 27 and is journaled for steering movement about a generally vertically extending steering axis by means of a swivel bracket 31. The swivel bracket 31 is, in turn, pivotally connected to a clamping bracket 32 by means of a pivot pin 33 for tilt and trim movement of the outboard motor 21 about a generally horizontally extending axis defined by the pivot pin 33. The clamping bracket 32 includes a clamping device 34 for affixing the outboard motor 21 to a transom 35 of an associated watercraft.

The construction of the outboard motor 21 as thus far described may be considered to be conventional and, for that reason, details of its construction not necessary to understand the construction and operation of the invention have not been illustrated nor will they be described.

Figure 2:
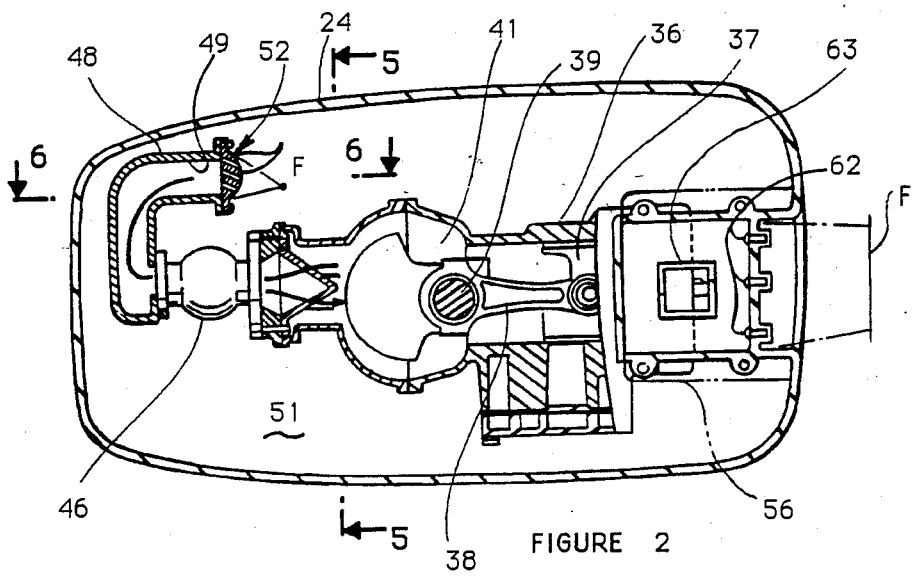
FIG. 2 is a cross-sectional view taken along the line 2—2 of FIG. 1.

Referring now initially in detail to FIG. 2, the engine 23 is, in the illustrated embodiment, depicted as being of the crankcase compression two cycle type. The engine includes a cylinder block 36 having a cylinder bore in which a piston 37 reciprocates. The piston 37 is connected by means of a connecting rod 38 to a crankshaft 39 which rotates about a generally vertically disposed axis. The crankshaft 39 is connected to the drive shaft 26 for driving it in a known manner and rotates within a sealed crankcase chamber 41.

An intake charge is formed by means of a carburetor 46 and is admitted to the crankcase chamber 41 through a reed type valve assembly 46 for precluding reverse flow. In accordance with the invention, the carburetor 47 is provided with an air intake device 48 having an air inlet opening 49 that communicates with a chamber 51 defined within the outer cowling 25.

In accordance with the invention, an acoustical lens 52 extends across the opening 49 and has a plurality of inlet openings that are configured so as to define a focal point F which is disposed rearwardly of the operator, who will be positioned in front of the outboard motor 21 so that the sound waves emanating from the induction system will be directed away from the operator. Also, the acoustical lens 52 cooperates and functions so as to provide a silencing arrangement wherein the sound waves focused at the focal point F interfere with each other so as to achieve a sound deadening effect.

Figure 5:
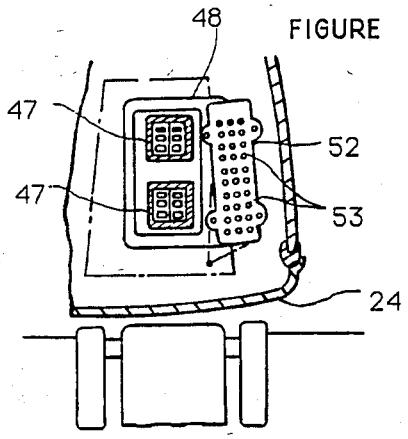
FIG. 5 is a partial cross-sectional view taken along the line 5—5 of FIG. 2.

As may be best seen in FIG. 5, the engine is depicted as being of the two cylinder in-line type and there is provided a single acoustical lens 52 having the focused openings 53 for achieving silencing. It is to be understood that the invention can be used in conjunction with engines of different types and different cylinder numbers and that separate intake devices may be provided for each of the carburetors or charge forming devices and each intake device may be provided with an acoustical lens.

Figure 6:
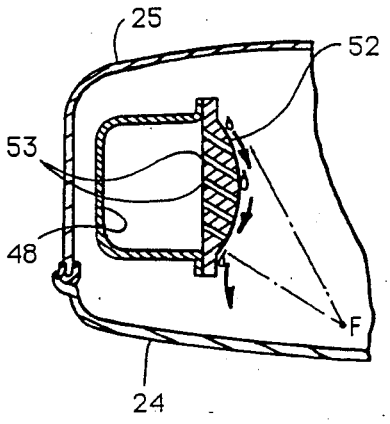
FIG. 6 is a cross-sectional view taken along the line 6—6 of FIG. 2.

As may be seen in FIG. 6, the openings 53 and lens 52 are configured so that the openings also face downwardly so that the focal point F is not only spaced rearwardly from the operator but is directed downwardly toward the tray 25. Because of the downward facing of the openings 52, any water which may be drawn into the outer cowling comprised of the tray 24 and cover 25 will pass downwardly across the inlet ends of the openings 53 and is not likely to be drawn upwardly into the induction system.

Figure 3:
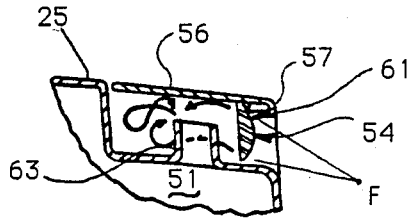
FIG. 3 is a cross-sectional view showing the atmospheric air induction inlet.

An arrangement is provided for admitting atmospheric air into the cowling chamber 51 and this atmospheric inlet is best shown in FIGS. 1 and 3 and is identified generally by the reference numeral 54. The atmospheric inlet 54 is designed so as to facilitate the separation of water from the intake air and also incorporates an acoustical lens as will be described.

Figure 4:
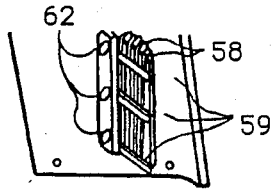
FIG. 4 is a perspective view showing the under and rear side of the air inlet device.

The main cowling portion 25 is provided with a recessed area 55 at its rear end which is closed partially by means of a cover plate 56 so as to define a rearwardly facing air inlet opening. This air inlet opening is controlled in part by means of an acoustical lens, indicated generally by the reference numeral 57 and which has a construction as best shown in FIG. 4. The acoustical lens 57 is formed with a plurality of slats 58 that are held together by means of bridging members 59 and which define openings 61 through which the sound waves may emanate and through which air may pass. The openings 61 and lens 57 are directed downwardly and rearwardly so as to define a focal point F which will achieve the desired silencing. The bridging plates 59 are affixed to each other by means of fasteners 62 so as to hold the lens 57 in place.

The cowling recess 55 is formed with an upwardly extending tuning neck 63 which provides a tortuous flow path so that air may enter into the cowling cavity 51 but water will be separated. In addition, the downwardly facing direction of the slat openings 61 and lens 57 will also assist in assuring that water does not enter into the cowling interior 51.

The engine 23 is also provided with an exhaust system that is comprised of an exhaust pipe 64 (FIG. 1) that is affixed to the lower face of the engine and which communicates with its exhaust ports. The exhaust pipe 64 delivers exhaust gases from the engine exhaust ports to an expansion chamber 65 that is formed internally of the drive shaft housing 27. Exhaust gases are discharged under high speed running conditions from the expansion chamber to an underwater exhaust gas discharge which may, as in the illustrated embodiment, comprise a through the propeller exhaust gas discharge 66.

The exhaust pipe 64 is generally spaced from the interior of the drive shaft housing 27 but there is, however, provided a membrane 67 that is sealed to the exhaust pipe 64 and the drive shaft housing 27 by means of seals 68 so as to define a water chamber 69 to which water is delivered through a water passage 71 from the outlet of the engine cooling jacket. The water chamber 69 encircles the exhaust pipe 64 and provides cooling for it. This also assists in silencing. Water is discharged from the water chamber 69 back into the body of water at which the watercraft is operating through drain passages 72 formed in the membrane 67 so as to maintain the desired water level.

The underwater discharge 66 is effective to provide silencing under high speed running conditions. However, when the outboard motor 21 is operating at low speeds the watercraft will be relatively deeply submerged and the water pressure at the underwater outlet 66 will be too great to permit the idle exhaust gas discharge through this passage.

Therefore, the engine is provided with an above the water exhaust gas discharge for operating under these running conditions. This discharge includes a passageway 73 that has an opening 74 into the expansion chamber 65. The passageway 73 further communicates with a second expansion chamber 75 that has a rearwardly facing discharge opening 76. In accordance with the invention, an acoustical lens, indicated generally by the reference numeral 77 extends across the opening 76 to provide effective silencing under conditions when the exhaust gases are discharged to the atmosphere through the above the water exhaust gas discharge 76. Like the acoustical lenses utilized in conjunction with the induction system, the acoustical lens 77 has a plurality of openings 78 and a convexly curved surface through which the opening 78 pass. In this embodiment, the convex configuration is such so as to provide a focal point F that is disposed rearwardly of the outboard motor 21 so as to direct the sound waves away from the operator and to provide good silencing. In addition, the openings 78 are downwardly inclined so as to preclude the likelihood of entry of water into the exhaust system through the above the water exhaust gas discharge 76.

In connection with the exhaust lens 77, the openings 78 in it should be relatively small in order to achieve the desired sound silencing. Because of the fact that the exhaust gases may tend to heat the lens 77 and cause evaporation of the water from both the cooling openings 72 and also from the body of water in which the watercraft is operating, there is a danger of mineral deposits clogging the openings. Therefore, it is desirable to cool the exhaust gases as well as silence them before they reach the lens 77. The combination of the expansion chambers 65 and 75 and the small interconnecting passageway 73 provide a cooling function in addition to a silencing function so as to avoid heating of the lens 77.

Figure 7:
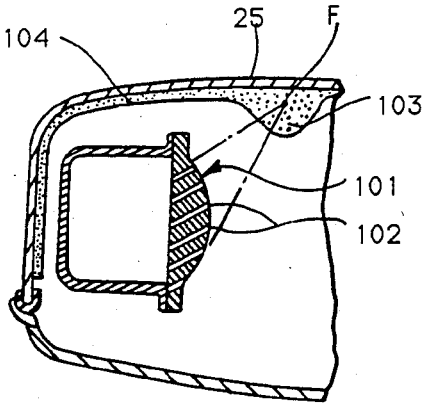
FIG. 7 is a cross-sectional view, in part similar to FIG. 6, showing another embodiment of the invention and is taken generally along the line 7—7 of FIG. 8.
Figure 8:
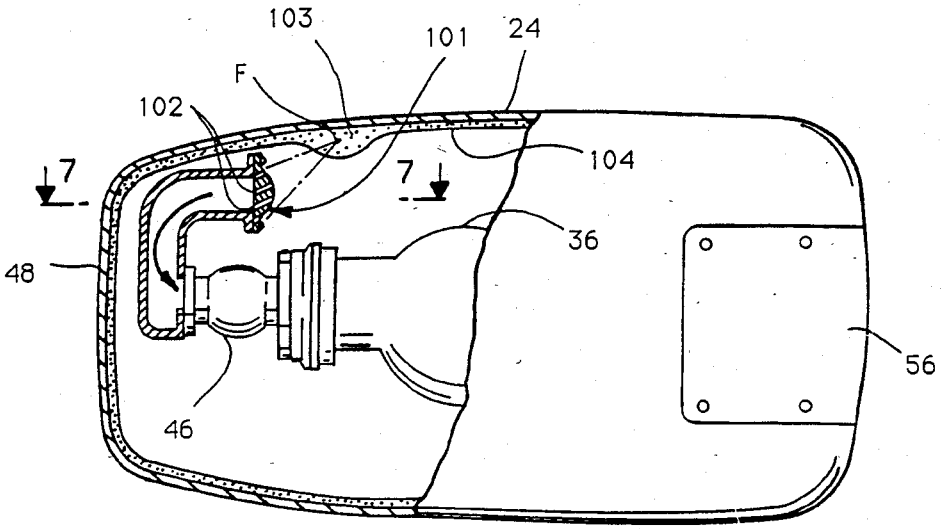
FIG. 8 is a top plan view, with a portion broken away, similar to FIG. 2 and shows this embodiment.

FIGS. 7 and 8 show another embodiment of the invention which differs from the embodiment of FIGS. 1 through 6 only in the configuration of the acoustical lens associated with the inlet device 48 for the carburetors 46 and its cooperation with the outer cowling. In this embodiment, an acoustical lens 101 is positioned across the inlet openings 49 of the inlet device and have passageways 102 that are directed toward a protuberance 103 in a sound deadening material 104 that is carried by the outer cowling portion 25. The focal point F of the openings 102 is located at the center of the mass of the protuberance 103 and thus will effect further sound deadening.

Figure 9:
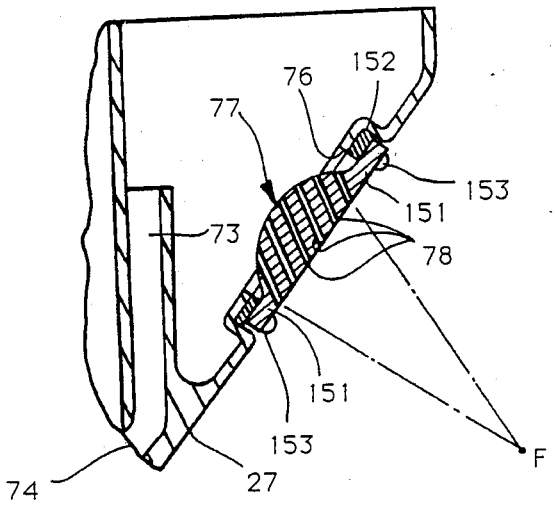
FIG. 9 is an enlarged cross-sectional view showing another embodiment of exhaust silencing device.

FIG. 9 shows another embodiment of the invention which is generally similar to the embodiment of FIGS. 1 through 6 and shows another mounting arrangement for the acoustical lens 77. Components of this embodiment which are the same as the previously described embodiment have been identified by the same reference numerals.

In this embodiment, the drive shaft housing 27 is provided with a recessed portion that defines the above the water discharge opening 76. The acoustical lens 77 is provided with a flange 151 that lies against a sealing and insulating gasket 152 and which is held in place by rivets 153. The gasket 152 further assists in reducing the heat transfer to the lens 77 to avoid mineral deposits for the reasons aforenoted.

Figure 10:
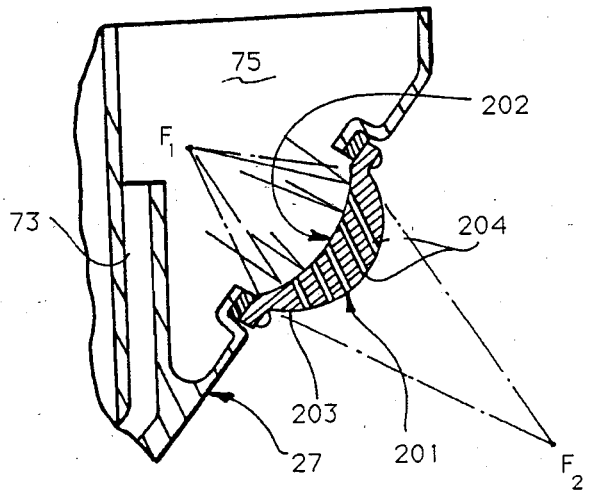
FIG. 10 is an enlarged cross-sectional view, in part similar to FIG. 9, showing another embodiment of the invention.

FIG. 10 shows yet another embodiment of the invention that is associated with the above the water exhaust gas discharge opening 76. In this embodiment, a convex/concave acoustical lens 201 is affixed across the opening 76 and has a concave portion 202 that faces the expansion chamber 75 and which defines a rearwardly facing focal point $F_1$ that focuses the sound waves rearwardly so as to provide a silencing within the expansion chamber 75. In addition, the lens 201 has a convex portion 203 through which the openings 204 extend and which defines a rearward focal point $F_2$ that provides silencing for the sound waves. As a result, there is a more effective silencing of the exhaust gases in this embodiment due to the convex/concave configuration of the lens 201.

Figure 11:
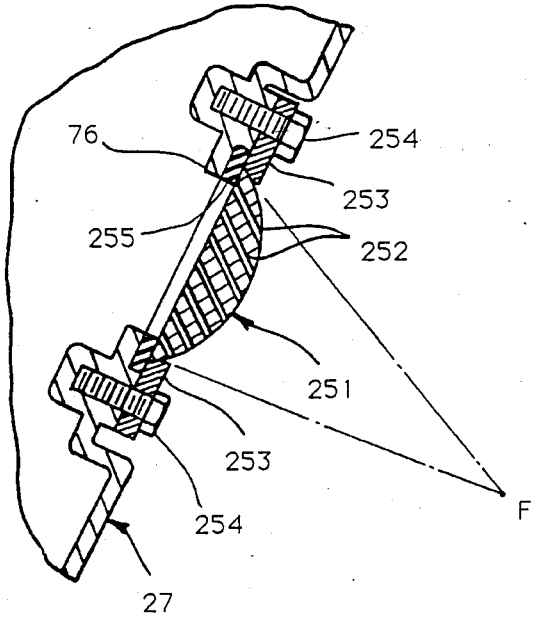
FIG. 11 is an enlarged cross-sectional view, in part similar to FIGS. 9 and 10, showing yet another embodiment of the invention.

FIG. 11 shows a still further embodiment of the invention that may be utilized to secure an acoustical lens 251 across the opening 76 of the drive shaft housing 27. In this embodiment, the lens 251 has angled openings 252 that define a rearwardly positioned focal point F. A retainer plate 253 has an opening which receives the lens 251 and is held in place by threaded fasteners 254. A sealing and heat insulating gasket 255 is interposed between the lens 251 and the drive shaft housing 27 so as to effect sealing. Like the previously described embodiments, the openings 252 and lens 251 are downwardly directed so as to preclude the likelihood of water entry.

Figure 12:
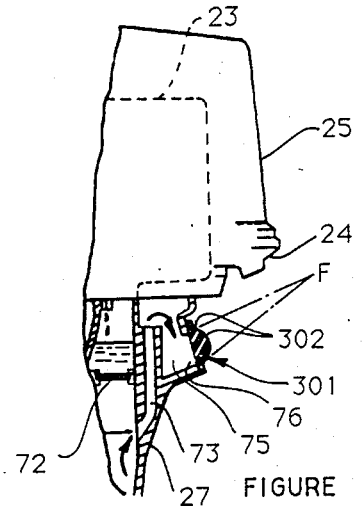
FIG. 12 is a partial side elevational view, with a portion shown in cross-section, showing yet another embodiment of exhaust silencing device.
Figure 13:
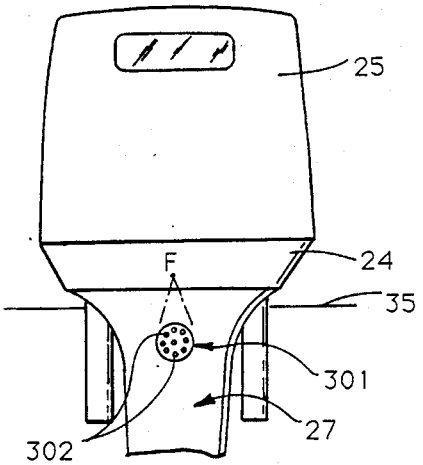
FIG. 13 is a rear elevational view of the embodiment shown in FIG. 12.

FIGS. 12 and 13 show another embodiment of the invention utilized to provide silencing of the above the water exhaust gas discharge. In this embodiment, an acoustical lens 301 is positioned across the above the water exhaust gas discharge opening 76 and has its openings 302 directed upwardly so as to define a focal point F that lies to the rear of the outer cowling comprised of the tray 24 and cover portion 25. As a result, the sound waves will be directed to an area behind the mass of the power head 22 and, accordingly, there will be a further silencing effect achieved due to this focusing of the sound waves in an area behind the large mass of the power head.

All of the embodiments of the invention as thus far described have been associated with the induction and exhaust systems for an outboard motor. It is to be understood, however, that many facets of the invention can be utilized in conjunction with the intake and exhaust systems of inboard engines or of inboard/outboard drives that employ underwater and above the water exhaust gas discharges.

Figure 14:
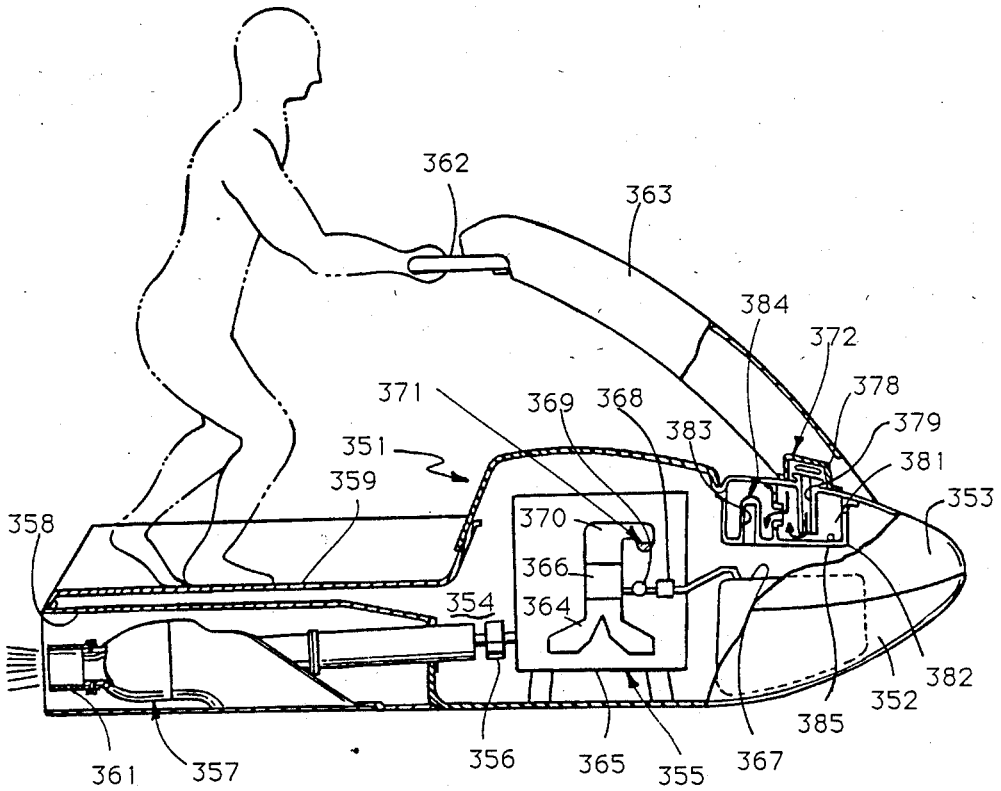
FIG. 14 is a side elevational view, with portions shown in cross-section of yet another embodiment of the invention.

For example, FIG. 14 illustrates the application of the principle to a watercraft of the jet propelled type which small watercraft is indicated generally by the reference numeral 351. The watercraft 351 is designed so as to provide a hull consisting of a lower portion 352 and an upper portion 353 that define a forwardly positioned engine compartment 354. An internal combustion engine 355 is contained within the engine compartment 354 and drives a coupling 356 that is coupled to a jet drive unit 357 that is positioned in a tunnel 358 positioned beneath a rider's area 359. The jet drive unit 357 has a pivotally supported discharge nozzle 361 that is steered by means of a handlebar assembly 362 for steering of the watercraft in a known manner. The handlebar assembly 362 is supported at the rear end of a pivoted mast 363.

The engine 355, which may be of any known type, is provided with an induction system comprised of an intake manifold 364 that discharges a fuel air mixture into a crankcase 365 in as much as the engine 355 is of the crankcase compression two cycle type. A carburetor 366 forms a fuel air charge from fuel supplied from a fuel tank 367 through a fuel conduit having a filter 368 and fuel pump 369. Air is delivered to the carburetor 366 through an intake device 370 having an inlet opening in which an acoustical lens 371 of the type aforedescribed is incorporated. The acoustical lens 371 focuses the sound waves emanating from the induction system in such a manner as to achieve a silencing effect, as aforedescribed.

The intake device 370 draws air through the acoustical lens 371 from the engine compartment 354. Air is delivered to the engine compartment 354 through an intake device and water separator, indicated generally by the reference numeral 372 and which includes an atmospheric air inlet 378 that is mounted on the upper hull portion 353 so as to admit air through a downwardly extending conduit 379 into a chamber 381 formed by a box like element 382 that is affixed to the underside of the hull upper portion 353. The box like element has an upwardly extending inlet pipe 383 that receives air through an acoustical lens 384 for silencing. A drain 385 permits water which is separated through the tortuous path of the intake device and water separator 372 to be drained from the intake box 382. The water separation provided by the device 372 insures that the openings in the lens 384 will not become clogged by the minerals present in the water.

It should readily apparent from the foregoing description that a number of embodiments of the invention have been illustrated and described and each of which is effective to provide good silencing for a marine propulsion device through the use of an acoustical lens. The acoustical lenses are configured so as to focus the sound waves in such a way as to improve silencing while, at the same time, ensuring against the entry of water back into the engine combustion chambers through either the intake system or the exhaust system. Also in many embodiments the lens is protected from clogging from minerals in the water by either heat insulation, water separation or both. Although a number of embodiments of the invention have been illustrated and described, various other changes and modifications may be made without departing from the spirit and scope of the invention, as defined by the appended claims.

We claim:

1. In a marine propulsion unit comprised of an internal combustion engine having an output shaft, a marine propulsion device driven by said engine output shaft, said engine having an induction system comprised of an atmospheric air inlet device for delivering an air charge to said engine for combustion, and an exhaust system having an exhaust outlet device for discharging exhaust gases from said engine to the atmosphere, the improvement comprising an acoustical lens extending at least in part across at least one of said devices for silencing sound waves emanating therefrom.

2. In a marine propulsion unit as set forth in claim 1 wherein the acoustical lens focuses the sound waves away from the marine propulsion unit.

3. In a marine propulsion unit as set forth in claim 2 wherein the acoustical lens focuses the sound waves behind a mass of the engine.

4. In a marine propulsion unit as set forth in claim 3 wherein the marine propulsion device and the internal combustion engine form an outboard motor with the propulsion unit being located on a lower unit thereof and the internal combustion engine being located in a power head.

5. In a marine propulsion unit as set forth in claim 4 wherein the sound waves are focused behind the power head of the outboard motor by the acoustical lens.

6. In a marine propulsion unit as set forth in claim 1 wherein the acoustical lens comprises a concave/convex lens for achieving silencing on both sides of the lens.

7. In a marine propulsion unit as set forth in claim 6 wherein the concave portion of the lens directs the sound waves to a forwardly directed focal point positioned behind a mass of the engine and the convex portion of the lens directs the sound waves in a rearward direction.

8. In a marine propulsion unit as set forth in claim 7 wherein the lens openings extend downwardly for precluding water entering into the associated device.

9. In a marine propulsion unit as set forth in claim 1 wherein the acoustical lens is formed with downwardly directed openings for precluding water entry into the associated device.

10. In a marine propulsion unit as set forth in claim 9 wherein the downwardly directed openings are formed by slat like portions of the lens to define elongated downwardly directed openings.

11. In a marine propulsion unit as set forth in claim 1 wherein the acoustical lens is associated with the exhaust system.

12. In a marine propulsion unit as set forth in claim 11 wherein the acoustical lens is formed with downwardly directed openings for precluding water entry into the associated device.

13. In a marine propulsion unit as set forth in claim 11 wherein the acoustical lens comprises a concave/convex lens for achieving silencing on both sides of the lens.

14. In a marine propulsion unit as set forth in claim 11 wherein the lens is insulated from exhaust heat from the engine.

15. In a marine propulsion unit as set forth in claim 14 wherein the lens is insulated from exhaust heat by providing a heat insulating gasket for supporting the lens.

16. In a marine propulsion unit as set forth in claim 14 wherein the lens is insulated from the exhaust heat by providing a series of expansion chambers upstream of the lens for cooling the exhaust gases.

17. In a marine propulsion unit as set forth in claim 6 wherein the concave portion of the lens directs the sound waves to a forwardly directed focal point positioned behind a mass of the engine and the convex portion of the lens directs the sound waves in a rearward direction.

18. In a marine propulsion unit as set forth in claim 14 wherein the lens has openings that extend downwardly for precluding water entering into the associated device.

19. In a marine propulsion unit as set forth in claim 1 wherein the lens is protected from water condensation in openings of the lens by providing a water separator upstream from the lens.

20. In a marine propulsion unit as set forth in claim 19 wherein the lens is provided in the induction system and the water separator provides an air inlet to the induction system.

21. In a marine propulsion unit as set forth in claim 19 wherein the lens is provided in the exhaust system and the water separator comprises a plurality of expansion chambers interconnected by restricted openings.

* * * * *